US009303461B2

(12) United States Patent
Patel et al.

(10) Patent No.: US 9,303,461 B2
(45) Date of Patent: Apr. 5, 2016

(54) CUTTING ELEMENTS HAVING CURVED OR ANNULAR CONFIGURATIONS FOR EARTH-BORING TOOLS, EARTH-BORING TOOLS INCLUDING SUCH CUTTING ELEMENTS, AND RELATED METHODS

(71) Applicant: Baker Hughes Incorporated, Houston, TX (US)

(72) Inventors: Suresh G. Patel, The Woodlands, TX (US); Chaitanya K. Vempati, Conroe, TX (US); Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 574 days.

(21) Appl. No.: 13/661,917

(22) Filed: Oct. 26, 2012

(65) Prior Publication Data

US 2014/0116788 A1 May 1, 2014

(51) Int. Cl.
*E21B 10/567* (2006.01)
*E21B 10/573* (2006.01)

(52) U.S. Cl.
CPC ..... *E21B 10/567* (2013.01); *E21B 10/5673* (2013.01); *E21B 10/573* (2013.01)

(58) Field of Classification Search
CPC . E21B 10/5673; E21B 10/5635; E21B 10/55; E21B 10/573; E21B 10/5676; E21B 10/5735
See application file for complete search history.

(56) References Cited

U.S. PATENT DOCUMENTS 4,553,615 A 11/1985 Grainger
4,606,418 A * 8/1986 Thompson ..... 175/429
4,654,947 A 4/1987 Davis
4,751,972 A 6/1988 Jones et al.
4,997,049 A * 3/1991 Tank et al. ..... 175/430
5,316,095 A 5/1994 Tibbitts
5,447,208 A * 9/1995 Lund et al. ..... 175/428
5,449,048 A * 9/1995 Thigpen et al. ..... 175/430
5,590,729 A 1/1997 Cooley et al.
5,653,300 A 8/1997 Lund et al.
5,706,906 A * 1/1998 Jurewicz et al. ..... 175/428

(Continued)

FOREIGN PATENT DOCUMENTS

EP 0811112 B1 5/2001
GB 2428709 A 2/2007
WO 2007044791 A1 4/2007

OTHER PUBLICATIONS

Patel et al., U.S. Appl. No. 13/871,935, entitled "Rotatable Cutting Elements and Related Earth-Boring Tools and Methods," filed Apr. 26, 2013.

(Continued)

*Primary Examiner* — Robert E Fuller
(74) *Attorney, Agent, or Firm* — TraskBritt

(57) ABSTRACT

Cutting elements for earth-boring tools include a substrate having a front end surface, an opposing back end surface, and at least one side surface extending between the front end surface and the back end surface. A volume of polycrystalline hard material is disposed on the front end surface of the substrate. The substrate and polycrystalline hard material may have a curved or an annular configuration defining an aperture within the cutting element. Earth-boring tools include such cutting elements. Methods of forming earth-boring tools include attaching such one or more such cutting elements to a body of an earth-boring tool.

19 Claims, 7 Drawing Sheets

(56) References Cited

U.S. PATENT DOCUMENTS

| | | | | |
|---|---|---|---|---|
| 5,924,501 | A * | 7/1999 | Tibbitts | 175/429 |
| 5,975,811 | A | 11/1999 | Briese et al. | |
| 6,508,516 | B1 | 1/2003 | Kammerer | |
| 6,527,065 | B1 | 3/2003 | Tibbitts et al. | |
| 6,932,172 | B2 | 8/2005 | Dvorachek | |
| 7,363,992 | B2 * | 4/2008 | Stowe et al. | 175/426 |
| 7,703,559 | B2 | 4/2010 | Shen et al. | |
| 8,091,655 | B2 | 1/2012 | Shen et al. | |
| 8,210,285 | B2 | 7/2012 | Cooley et al. | |
| 8,210,288 | B2 * | 7/2012 | Chen et al. | 175/430 |
| 8,216,677 | B2 * | 7/2012 | Mukhopadhyay et al. | 428/408 |
| 8,413,746 | B2 | 4/2013 | Shen et al. | |
| 8,991,523 | B2 | 3/2015 | Shen et al. | |
| 2002/0153175 | A1 | 10/2002 | Ojanen | |
| 2003/0209366 | A1 | 11/2003 | McAlvain | |
| 2004/0231894 | A1 | 11/2004 | Dvorachek | |
| 2007/0278017 | A1 | 12/2007 | Shen et al. | |
| 2008/0017419 | A1 | 1/2008 | Cooley et al. | |
| 2008/0085407 | A1 | 4/2008 | Cooley et al. | |
| 2008/0251293 | A1 | 10/2008 | Mumma et al. | |
| 2008/0264696 | A1 * | 10/2008 | Dourfaye et al. | 175/428 |
| 2010/0012388 | A1 * | 1/2010 | Shamburger et al. | 175/431 |
| 2010/0084198 | A1 * | 4/2010 | Durairajan et al. | 175/430 |
| 2010/0307829 | A1 * | 12/2010 | Patel | 175/57 |
| 2011/0031031 | A1 * | 2/2011 | Vempati et al. | 175/428 |
| 2011/0073379 | A1 * | 3/2011 | DiGiovanni et al. | 175/428 |
| 2011/0259642 | A1 | 10/2011 | DiGiovanni et al. | |
| 2013/0292185 | A1 | 11/2013 | Knull et al. | |

OTHER PUBLICATIONS

Smith Bits, A Schlumberger Company, Technology Development Bulletin—Rolling Cutter, Marketing & Technology, Apr. 2012, 3 pages.

Smith Bits, A Schlumberger Company, Technology Development Bulletin—Rolling Cutter, Marketing & Technology, Oct. 2012, 7 pages.

Zijsling, D. H., Single Cutter Testing—A Key for PDC Bit Development, Society of Petroleum Engineers, SPE 16529/1 Offshore Europe Aberdeen, Sep. 8-11, 1987, 14 pages.

* cited by examiner

CUTTING ELEMENTS HAVING CURVED OR ANNULAR CONFIGURATIONS FOR EARTH-BORING TOOLS, EARTH-BORING TOOLS INCLUDING SUCH CUTTING ELEMENTS, AND RELATED METHODS

TECHNICAL FIELD

Embodiments of the present disclosure relate to earth-boring tools, cutting elements for such earth-boring tools, and related methods.

BACKGROUND

Earth-boring tools for forming boreholes in subterranean earth formations, such as for hydrocarbon production, carbon dioxide sequestration, etc., generally include a plurality of cutting elements secured to a body. For example, fixed-cutter earth-boring rotary drill bits (also referred to as "drag bits") include cutting elements fixed to a bit body of the drill bit. Similarly, roller cone earth-boring rotary drill bits may include cones mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, which are cutting elements that include cutting faces of a polycrystalline diamond material. Polycrystalline diamond material is material that includes inter-bonded grains or crystals of diamond material. In other words, polycrystalline diamond material includes direct, inter-granular bonds between the grains or crystals of diamond material. The terms "grain" and "crystal" are used synonymously and interchangeably herein.

PDC cutting elements are formed by sintering and bonding diamond grains together under conditions of high temperature and high pressure in the presence of a catalyst (e.g., cobalt, iron, nickel, or alloys and mixtures thereof) to form a layer or "table" of polycrystalline diamond material on a cutting element substrate. These processes are often referred to as high temperature/high pressure (or "HTHP") processes. The polycrystalline diamond in such a PDC cutting element includes inter-bonded diamond grains bonded directly to one another by diamond-to-diamond atomic bonds, and catalyst material in interstitial spaces between the inter-bonded diamond grains. The cutting element substrate may comprise a cermet material (i.e., a ceramic-metal composite material) such as cobalt-cemented tungsten carbide. In such instances, the cobalt or other catalyst material in the cutting element substrate may be swept into the diamond grains during sintering and serve as the catalyst material for forming the inter-granular diamond-to-diamond bonds between, and the resulting diamond table from, the diamond grains. In other methods, powdered catalyst material may be mixed with the diamond grains prior to sintering the grains together in an HTHP process.

BRIEF SUMMARY

In some embodiments, the present disclosure includes a cutting element for an earth-boring tool. The cutting element includes a substrate having a front end surface, an opposing back end surface, and at least one side surface extending between the front end surface and the back end surface. A volume of polycrystalline hard material is disposed on the front end surface of the substrate. The volume of polycrystalline hard material may have an annular configuration defining at least one aperture extending through the volume of polycrystalline hard material. The at least one aperture may be devoid of solid material, and may at least partially define a volume of open space within the cutting element having one or more openings through the volume of polycrystalline hard material to the volume of space from the exterior of the cutting element.

In additional embodiments, the present disclosure comprises an earth-boring tool that includes a cutting element attached to a body. The cutting element includes a substrate having a front end surface, an opposing back end surface, and at least one side surface extending between the front end surface and the back end surface. The cutting element further includes a volume of polycrystalline hard material disposed on the front end surface of the substrate. The volume of polycrystalline hard material may have an annular configuration defining at least one aperture extending through the volume of polycrystalline hard material. The at least one aperture is devoid of solid material and at least partially defines a volume of open space within the cutting element. The volume of space within the cutting element includes one or more openings extending through the volume of polycrystalline hard material to the volume of space from the exterior of the cutting element and the body of the earth-boring tool.

In yet further embodiments, the present disclosure includes a method of forming an earth-boring tool in which a cutting element is attached to a body of an earth-boring tool. The cutting element may be selected to include a substrate having a front end surface, an opposing back end surface, and at least one side surface extending between the front end surface and the back end surface. The cutting element may be further selected to include a volume of polycrystalline hard material disposed on the front end surface of the substrate. The volume of polycrystalline hard material may have an annular configuration defining at least one aperture extending through the volume of polycrystalline hard material. The cutting element and the body of the earth-boring tool may be configured and oriented such that the at least one aperture in the cutting element defines a void comprising a volume of space within the cutting element having one or more openings through the volume of polycrystalline hard material to the volume of space from the exterior of the cutting element and the body of the earth-boring tool.

In additional embodiments, the present disclosure comprises a cutting element for an earth-boring tool that includes a curved substrate having a front end surface, an opposing back end surface, a curved outer lateral side surface extending between the front end surface and the back end surface, and a curved inner lateral side surface extending between the front end surface and the back end surface. The cutting element further includes a volume of polycrystalline hard material disposed on the front end surface of the substrate. The volume of polycrystalline hard material may have a radial width of about 6.0 mm or less in a direction extending between the curved outer lateral side surface and the curved inner lateral side surface of the substrate. The volume of polycrystalline hard material may also have a polished front cutting surface having an average Ra surface roughness of about or 8.0 μ-in. or less.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the description of example embodiments set forth below, when read in conjunction with the accompanying drawings, in which:

DETAILED DESCRIPTION

The illustrations presented herein are not actual views of any particular cutting element or drill bit, and are not drawn to scale, but are merely idealized representations employed to describe embodiments of the disclosure. Elements common between figures may retain the same numerical designation.

As used herein, the term "drill bit" means and includes any type of bit or tool used for drilling during the formation or enlargement of a wellbore and includes, for example, rotary drill bits, percussion bits, core bits, eccentric bits, bi-center bits, reamers, expandable reamers, mills, drag bits, roller cone bits, hybrid bits, and other drilling bits and tools known in the art.

The term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., ionic, covalent, metallic, etc.) between atoms in adjacent grains of material.

Figure 1A:
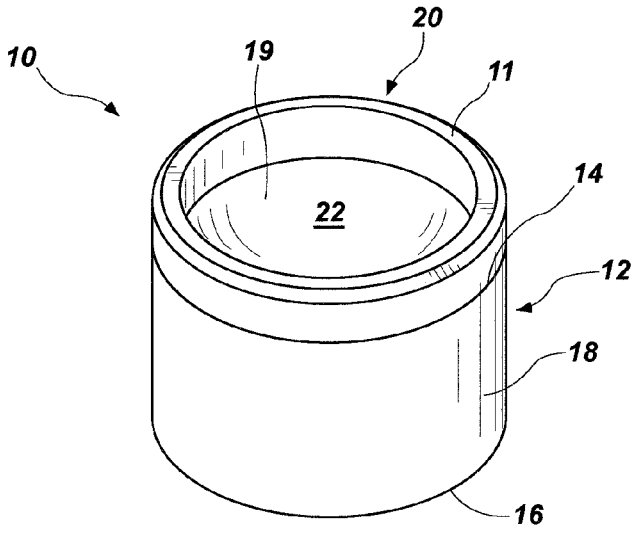
FIG. 1A is a perspective view of an embodiment of a cutting element for an earth-boring tool, wherein the cutting element includes a volume of polycrystalline hard material having an annular configuration disposed on an end of a substrate, and a void extends partially through the cutting element.
Figure 1B:
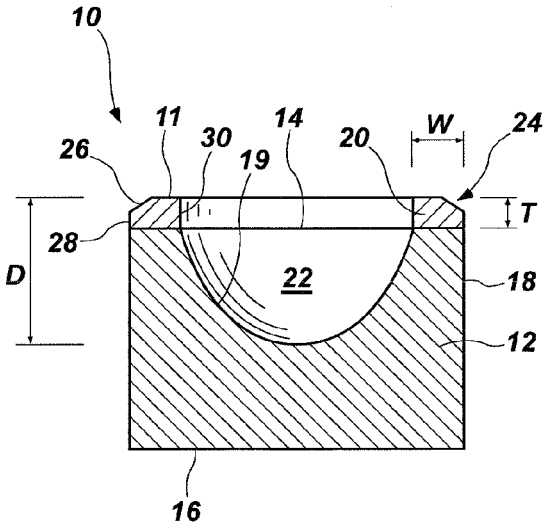
FIG. 1B is a side cross-sectional view of the cutting element of FIG. 1A.
Figure 1C:
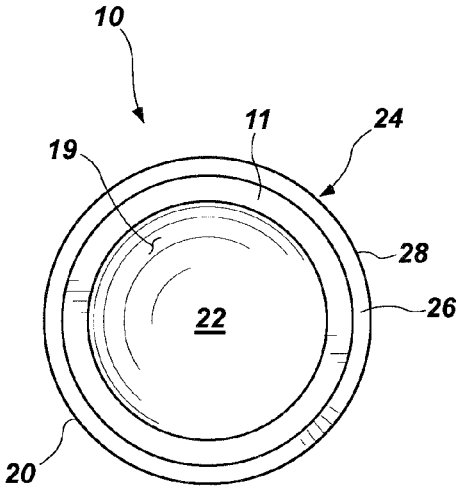
FIG. 1C is a top plan view of the cutting element of FIGS. 1A and 1B.

FIGS. 1A-1C illustrate an embodiment of a cutting element 10 of the present disclosure. The cutting element 10 includes a volume of polycrystalline hard material 20 disposed on a substrate 12. As discussed in further detail below with reference to FIG. 4A, the cutting element 10 has a configuration such that, as the cutting element 10 is used to cut formation material in use on an earth-boring tool, formation cuttings generated by the cutting element 10 slide only a short distance across a front cutting face 11 of the cutting element 10 before reaching a mouth of an aperture 22, which may also be characterized as a cavity, extending into the cutting element 10 from the front cutting face 11. For example, at least the volume of polycrystalline material 20 of the cutting element 10 may have an annular configuration to define such an aperture 22 within the cutting element 10.

The substrate 12 may comprise a relatively hard and wear-resistant material. As a non-limiting example, the substrate 12 may comprise a cemented carbide composite material, such as a cobalt-cemented tungsten carbide composite material. The substrate 12 has a front end surface 14, an opposing back end surface 16, and at least one outer side surface 18 extending between the front end surface 14 and the back end surface 16. The front end surface 14 of the substrate 12 is the leading surface of the substrate 12 when the cutting element 10 is attached to an earth-boring tool and used to cut formation material by moving the earth-boring tool and the cutting element 10 relative to the formation. Conversely, the back end surface 16 is the surface of the substrate 12 and is the trailing surface of the substrate 12 when the cutting element 10 is attached to an earth-boring tool and used to cut formation material by moving the earth-boring tool and the cutting element 10 relative to the formation. In some embodiments, the substrate 12 may comprise a single outer side surface 18 having a circular or oval cross-sectional shape. The substrate 12 may further include one or more inner surfaces 19 at least partially defining the aperture 22 in the cutting element 10.

The volume of polycrystalline hard material 20 comprises a plurality of grains (i.e., crystals) of the hard material that are bonded directly together by inter-granular bonds. The crystal structures of the individual grains of the material may be randomly oriented in space within the polycrystalline material. The volume of polycrystalline hard material 20 may comprise a material exhibiting a Knoop hardness value of about 2,000 $Kg_f/mm^2$ (20 GPa) or more, or even about 3,000 $Kg_f/mm^2$ (29.4 GPa) or more. For example, the volume of polycrystalline hard material 20 may comprise a volume of polycrystalline diamond or a volume of polycrystalline cubic boron nitride. As previously discussed herein, such polycrystalline hard materials, such as polycrystalline diamond, may be formed using what are referred to in the art as "HTHP" sintering processes. Such processes involve sintering and bonding diamond grains together under conditions of high temperature and high pressure in the presence of a catalyst (e.g., cobalt, iron, nickel, or alloys and mixtures thereof) to form a layer or "table" of polycrystalline hard material. The volume of polycrystalline hard material 20 may be formed on the substrate 12 in an HTHP process, or the volume of polycrystalline hard material 20 may be formed separately from the substrate 12 and subsequently attached thereto.

The volume of polycrystalline hard material 20 may be disposed on the front end surface 14 of the substrate 12. As shown in FIG. 1A, the volume of polycrystalline hard material 20 has an annular configuration defining a mouth of an aperture 22 extending through the volume of polycrystalline hard material 20. As used herein, the term "annular" is to be interpreted in a broad sense, and include not only circular configurations, but also oval, elliptical and other configurations approximating a ring. The aperture 22 may be devoid of solid material, and may at least partially define a volume of space within the cutting element 10. There may be only a single opening to the volume of space from the exterior of the cutting element 10, and the single opening may extend through the volume of polycrystalline hard material 20. In other words, the only pathway between a location within the aperture 22 and the exterior of the cutting element 10, when the cutting element 10 is attached to a body of an earth-boring tool, is through an opening in the front cutting face 11 of the volume of polycrystalline hard material 20. As shown in FIGS. 1A-1C, the aperture 22 may extend entirely through the volume of polycrystalline hard material 20 and at least partially through the substrate 12 from the front end surface 14 of the substrate 12.

The volume of polycrystalline hard material 20 has a front cutting face 11 and a cutting edge 24 (FIG. 1B) defined at the outer periphery of the front cutting face 11. In some embodiments, the front cutting face 11 may comprise a planar, flat surface of the volume of polycrystalline hard material 20. As shown in FIG. 1B, the cutting edge 24 may include one or more chamfer surfaces 26 extending between the front cutting face 11 and a lateral side surface 28 of the volume of polycrystalline hard material 20. Cutting edge 24 may also include a radiused or other arcuate cross-section, alone or in combination with one or more chamfer surfaces. The volume of polycrystalline hard material 20 further includes an inner surface 30 that partially defines the aperture 22 within the cutting element 10 and intersects the front cutting face 11. In some embodiments, the inner surface 30 may be oriented substantially perpendicular to the front cutting face 11. For example, the angle between the front cutting face 11 may be between about 80° and about 100°, between about 85° and about 95°, or between about 87° and about 93° (e.g., about 90°). The inner surface 30 may have a circular or oval cross-sectional shape. Thus, the inner surface 30 may have a cylindrical shape in some embodiments.

With continued reference to FIG. 1B, the aperture 22 may extend a depth D into the cutting element 10 from the front cutting face 11 of the volume of polycrystalline hard material 20. The depth D may be, for example, at least about two millimeters (2.0 mm), at least about five millimeters (5.0 mm), or even at least about ten millimeters (10.0 mm).

The volume of polycrystalline hard material 20 may have a thickness T in a direction perpendicular to the front cutting face 11 of the volume of polycrystalline hard material 20 and the front end surface 14 of the substrate 12. The thickness T may be, for example, between about 1.5 mm and about 5.0 mm, and more particularly, between about 1.8 mm and about 3.5 mm.

The volume of polycrystalline hard material 20 may have a radial width W in a radial direction perpendicular to a longitudinal axis of the cutting element 10. The radial width W may be, for example, about 6.0 mm or less, about 4.0 mm or less, or even about 3.0 mm or less (e.g., about 2.54 mm). As discussed in further detail below with reference to FIGS. 4A and 4B, the radial width W corresponds to the distance that formation cuttings generated by the cutting element 10 slide across the front cutting face 11 before reaching the aperture 22. By forming the volume of polycrystalline hard material 20 may have a radial width W, the distance over the front cutting face 11 across which formation cuttings must slide before reaching the aperture 22 is caused to be low.

In addition, the front cutting face 11 of the volume of polycrystalline hard material 20 may be polished or otherwise caused to have a reduced surface roughness. By way of example and not limitation, the front cutting face 11 may have a surface roughness of about 8.0 μ-in. Ra or less, about 4.0 μ-in. Ra or less, or even about 2.0 μ-in. Ra or less (e.g., about 1.0 μ-in. Ra). Methods for polishing the front cutting face 11 of the volume of polycrystalline hard material 20 to attain such Ra surface roughness values are disclosed in, for example, U.S. Pat. No. 5,447,208, issued Sep. 5, 1995 to Lund et al. and U.S. Pat. No. 5,653,300, issued Aug. 5, 1997 to Lund et al., the disclosure of each of which patent is incorporated herein in its entirety by this reference.

Figure 2A:
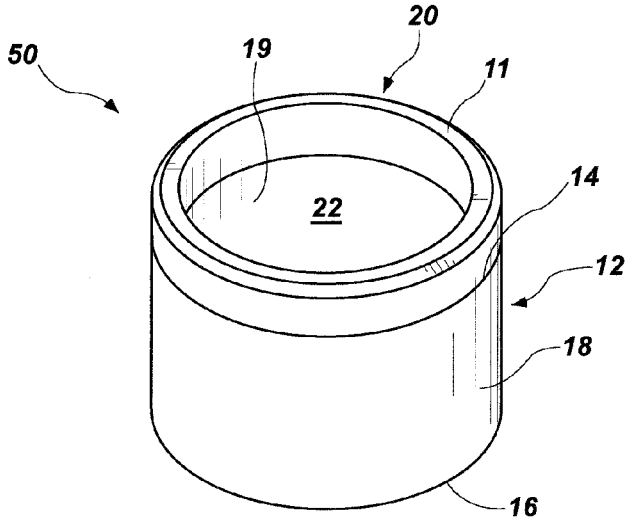
FIG. 2A is a perspective view of another embodiment of a cutting element similar to that of FIGS. 1A-1C, wherein the cutting element includes a volume of polycrystalline hard material having an annular configuration disposed on an end of a substrate, but wherein a void extends entirely through the cutting element.
Figure 2B:
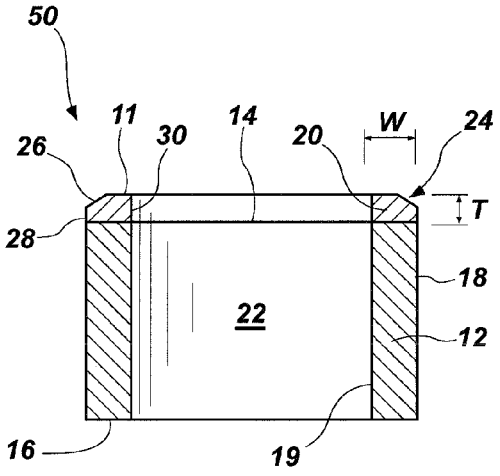
FIG. 2B is a side cross-sectional view of the cutting element of FIG. 2A.
Figure 2C:
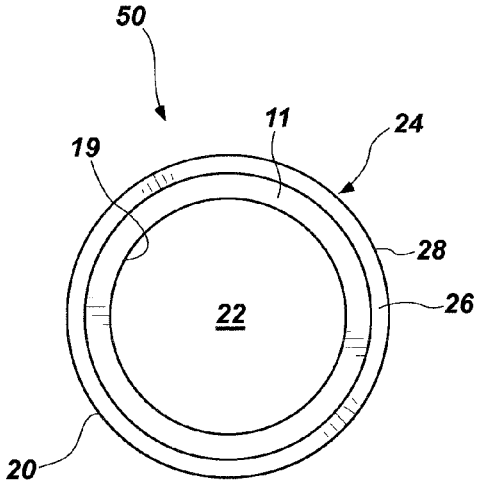
FIG. 2C is a top plan view of the cutting element of FIGS. 2A and 2B.

The cutting element 10 of FIGS. 1A-1C includes an aperture 22 that extends partially through the substrate 12. In additional embodiments, the aperture 22 may extend entirely through the substrate 12 and the cutting element 10. For example, FIGS. 2A through 2C depict an additional embodiment of a cutting element 50 of the present disclosure. The cutting element 50 may be as described in relation to the cutting element 10 with reference to FIGS. 1A through 1C, except that the cutting element 50 includes an aperture 22 that extends entirely through the substrate 12 and the cutting element 50, such that the aperture 22 is open to the back end surface 16 of the substrate 12. In other words, the substrate 12 includes a cylindrical inner surface 19 extending entirely through the substrate 12 between the front end surface 14 and the back end surface 16.

Although the cutting element 50 of FIGS. 2A-2C includes an opening to the aperture 22 at the front cutting face 11 of the volume of superabrasive hard material 20 and at the back end surface 16 of the substrate 12, in some embodiments, the cutting element 50 may be attached to a body of an earth-boring tool such that the opening to the aperture 22 at the back end surface 16 of the substrate 12 is covered by an adjoining surface of the body of the earth-boring tool. Thus, when attached to the body of an earth-boring tool, the aperture 22 may define a volume of space within the cutting element 50, and the only opening to the aperture 22 may be the opening at the front cutting face 11 of the volume of superabrasive hard material 20.

Figure 3:
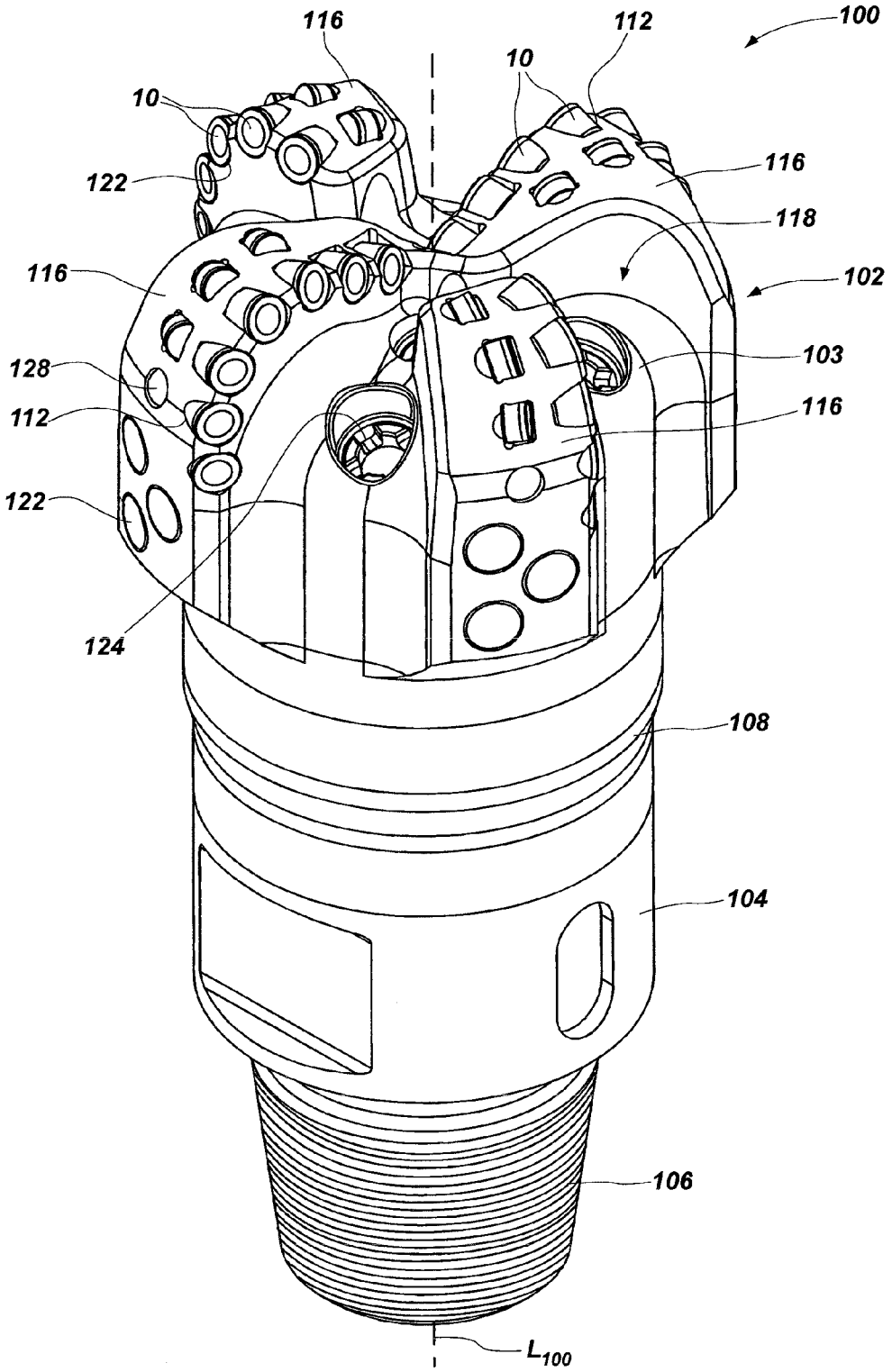
FIG. 3 is a perspective view of an embodiment of an earth-boring tool of the present disclosure comprising a plurality of cutting elements as described herein attached to a body of a fixed-cutter rotary drill bit.

FIG. 3 is a perspective view of an embodiment of an earth-boring tool of the present disclosure that includes one or more cutting elements as described herein attached to a body of the earth-boring tool. For example, the earth-boring tool may comprise a fixed-cutter rotary drill bit 100 that includes a plurality of cutting elements 10 as described with reference to FIGS. 1A-1C attached to a bit body 102 of the drill bit 100. The other embodiments of cutting elements as described herein also may be attached to a body of such an earth-boring tool.

The earth-boring rotary drill bit 100 includes a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 3, the bit body 102 may comprise a particle-matrix composite material, and may be secured to the shank 104 (e.g., a metal shank) using an extension 108. In other embodiments, the bit body 102 may be secured to the shank 104 using a metal blank embedded within the particle-matrix composite bit body 102, or the bit body 102 may be secured directly to the shank 104. In other embodiments, the bit body 102 may be at least substantially comprised by a steel alloy.

The bit body 102 may include internal fluid passageways (not shown) that extend between the face 103 of the bit body 102 and a longitudinal bore (not shown), which extends through the shank 104, the extension 108, and partially through the bit body 102. Nozzle inserts 124 also may be provided at the face 103 of the bit body 102 within the internal fluid passageways. The bit body 102 may further include a plurality of blades 116 that are separated by junk slots 118. In some embodiments, the bit body 102 may include gage wear plugs 122 and wear knots 128. A plurality of cutting elements 10, as previously disclosed herein, may be attached to the bit body 102 in cutting element pockets 112 that are located along each of the blades 116 at the face 103 of the drill bit 100. The cutting elements 10 are positioned to cut a subterranean formation being drilled while the drill bit 100 is rotated under weight-on-bit (WOB) in a borehole about centerline $L_{100}$.

The particular embodiment of the drill bit 100 shown in FIG. 3 is provided as a non-limiting example, and cutting elements 10 as described herein may be attached to fixed-cutter rotary drill bits having other configurations, as well as to other types of drill bits and other earth-boring tools.

Embodiments of cutting elements of the present disclosure also may be used as gauge trimmers, and may be used on other types of earth-boring tools. For example, embodiments of cutting elements of the present disclosure also may be used on cones of roller cone drill bits, on reamers, mills, bi-center bits, eccentric bits, coring bits, and so-called "hybrid bits" that include both fixed cutters and rolling cutters.

Figure 4A:
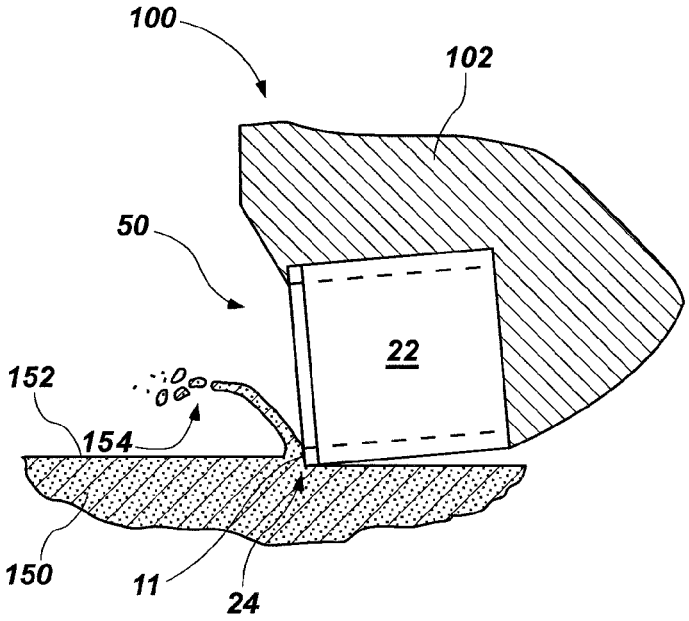
FIG. 4A is a simplified schematic illustration of a cutting element configured generally as depicted in FIGS. 2A-2C cutting a formation and generating formation cuttings.

FIG. 4A is a simplified drawing showing a cutting element 50 as described with reference to FIGS. 2A-2C, attached to a bit body 102 of a drill bit 100 like that described with reference to FIG. 3, cutting through a subterranean formation 150. As shown in FIG. 4A, the cutting element 50 may be oriented on the drill bit 100 and configured such that the cutting edge 24 of the volume of polycrystalline hard material 20 of the cutting element 50 extends a depth into the surface 152 of the subterranean formation 150. The material of the formation 150 immediately in front of the front cutting face 11 of the volume of polycrystalline hard material 20 is subjected to shear forces, which cause formation cuttings 154 (often referred to as "chips") to slide up and across the front cutting face 11 of the volume of polycrystalline hard material 20.

Figure 4B:
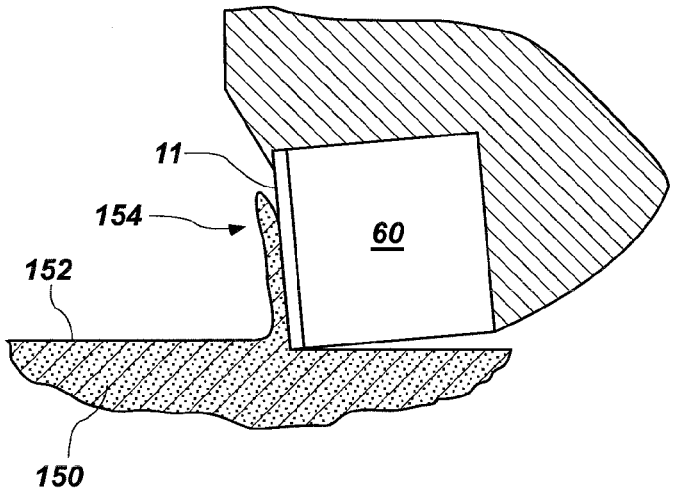
FIG. 4B (PRIOR ART)
FIG. 4B is similar to FIG. 4A but illustrates a conventional solid, cylindrical cutting element cutting a formation and generating formation cuttings.

FIG. 4B is similar to FIG. 4A, but illustrates a conventional solid, cylindrical cutting element 60 cutting a formation 150 and generating formation cuttings 154. As known in the art (see e.g., D. H. Zij sling, Single Cutter Testing—A Key for PDC Bit Development, Society of Petroleum Engineers (SPE) 16529 (1987)), shale formation cuttings 154 may have a tendency to stick to the front cutting faces 11 of such conventional cutting elements 60, which can lead to "balling" of a drill bit carrying such conventional cutting elements 60. Balling is a phenomenon in which a mass of formation cuttings 154 accumulates on the face of the drill bit due to an inability of the flow of drilling fluid from the interior of the drill bit to the bit face to clear the formation cuttings 154 from in front of the cutting elements, resulting in difficulty penetrating the formation 150 with the cutting elements 60, and reduced drilling efficiency. The sticking of formation cuttings 154 to the front cutting faces 11 of the cutting elements 60 is believed to be due, at least in part, to a differential in pressure between the wellbore fluid outside the formation cuttings 154 and the pore pressure within the cuttings 154.

Referring again to FIG. 4A, it has been observed during visual single cutter testing carried out under pressurized conditions simulating a downhole environment, that formation cuttings 154 generated using cutting elements 10, 50 as described herein may be propelled in a forward direction away from the front cutting face 11 of the cutting elements 10, 50 upon reaching the aperture 22. By configuring the cutting elements 10, 50 such that the formation cuttings slide a relatively short distance across the front cutting face 11 of the volume of polycrystalline hard material 20 (which distance corresponds to the radial width W shown in FIG. 1B and FIG. 2B), the tendency of the formation cuttings 154 to stick to the cutting elements 10, 50 may be reduced and formation cuttings 154 are projected into the path of drilling fluid on the drill bit face substantially transverse to the front cutting face 11 of cutting elements 10, 50, reducing the tendency of drill bits 100 carrying such cutting elements to experience balling during drilling.

A cutting element 50 as described with reference to FIGS. 2A through 2C was subjected to testing using a visual single point (VSP) testing system substantially as described in the aforementioned D. H. Zij sling, Single Cutter Testing—A Key for PDC Bit Development, Society of Petroleum Engineers (SPE) 16529 (1987), which is hereby incorporated herein in its entirety by this reference. TABLE 1 below lists three sets of different testing parameters.

TABLE 1

| Parameter Set | Feet Per Hour (ft./hr.) | Revolutions Per Minute (RPM) | Depth-of-Cut (Inches/Revolution) | Depth-of-Cut (Millimeters/Revolution) |
|---|---|---|---|---|
| 1 | 12 | 60 | 0.040 | 6.35 |
| 2 | 30 | 60 | 0.100 | 2.54 |
| 3 | 75 | 60 | 0.250 | 6.35 |

Tests were carried out at 3,000 psi bottom-hole pressure using mineral oil as the pressure medium in the pressurized chamber. A sample of Carthage rock having an unconfined compressive strength of 15,000 psi was tested using Parameter Set 1 in TABLE 1 using both a cutting element 50 as described with reference to FIGS. 2A-2C (Cutter Sample 1) and a cutting element as described in U.S. Patent Application Publication No. 2011/0259642 A1, which was published Oct. 27, 2011 in the name of DiGiovanni et al. (Cutter Sample 2). A sample of Catoosa shale having an unconfined compressive strength of 3,000 psi was tested using each of Parameter Sets 1 through 3 in Table 1 using both Cutter Sample 1 and Cutter Sample 2. During testing, tangential, axial, and radial forces were measured in real time.

Figure 5A:
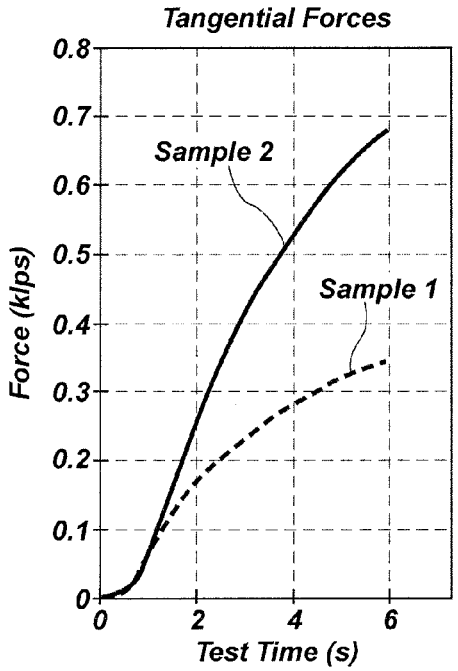
FIG. 5A is a graph of data acquired from tests and illustrates tangential forces acting on both a cutting element as described herein and a previously known cutting element during a cutting process as a function of test time.
Figure 5B:
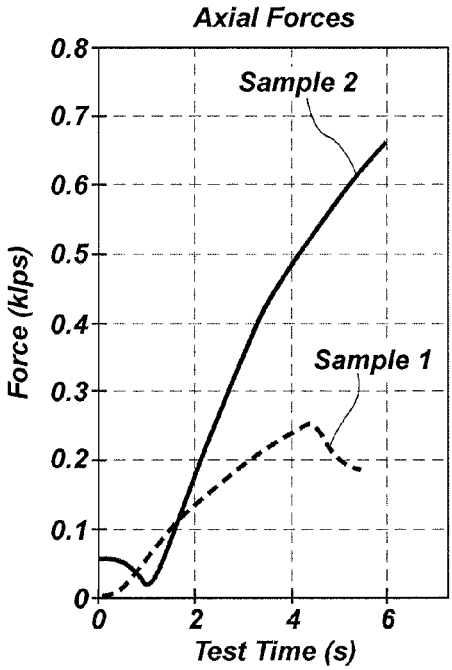
FIG. 5B is a graph of data acquired from tests and illustrates axial forces acting on both a cutting element as described herein and a previously known cutting element during a cutting process as a function of test time.
Figure 5C:
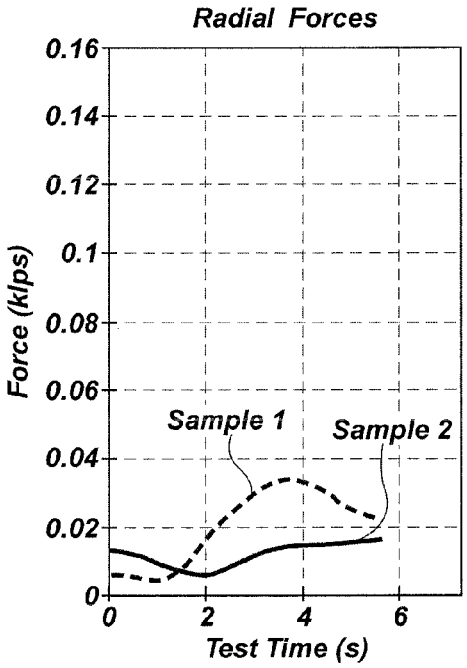
FIG. 5C is a graph of data acquired from tests and illustrates radial forces acting on both a cutting element as described herein and a previously known cutting element during a cutting process as a function of test time.
Figure 5D:
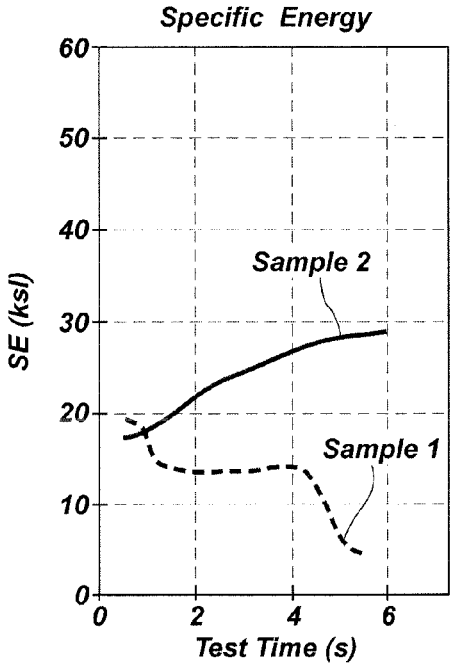
FIG. 5D is a graph of data acquired from tests and illustrates specific energy for a cutting element as described herein and a previously known cutting element during a cutting process as a function of test time, wherein the specific energy is calculated using the measured forces graphed in FIGS. 5A through 5C.

FIG. 5A is a simplified graph illustrating the average measured tangential force acting on Cutter Sample 1 and Cutter Sample 2 as a function of test time, FIG. 5B is a simplified graph illustrating the average measured axial force acting on Cutter Sample 1 and Cutter Sample 2 as a function of test time, and FIG. 5C is a simplified graph illustrating the average measured radial force acting on Cutter Sample 1 and Cutter Sample 2 as a function of test time. Specific Energy (SE) in a rock removal process may be defined as the amount of energy required to remove a unit volume of rock, and may be calculated using the following equation:

$$SpecificEnergy(psi) = \frac{Ft}{W * DOC} + \frac{Fn}{\pi * W * D},$$

wherein Ft is the tangential force (lb.), Fn is the normal or axial force (lb.), W is the width of the cutting element (in.), DOC is the depth-of-cut (in.), and D is the diameter of the cutting element (in.). FIG. 5D illustrates the Specific Energy for each of Cutter Sample 1 and Cutter Sample 2, as calculated using the measured forces represented in FIGS. 5A through 5B and the dimension of Cutter Sample 1 and Cutter Sample 2, as a function of test time.

As can be seen in FIGS. 5A through 5D, cutting elements as described herein (and represented by Cutter Sample 1) may experience lower cutting forces during cutting compared to previously known cutting elements (as represented by Cutter Sample 2), and, thus, may exhibit lower Specific Energy, which may result in improved cutting efficiency relative to previously known cutting elements.

It is appreciated that, due to the decreased volume and mass of the substrate 12 compared to previously known cutting elements, cutting elements as described herein may be more susceptible to damage and fracture during cutting than previously known cutting elements that do not include an aperture 22. Thus, to improve the strength and durability of the cutting elements described herein, they may optionally be provided with one or more internal cross-members within the cavity 22.

Figure 6:
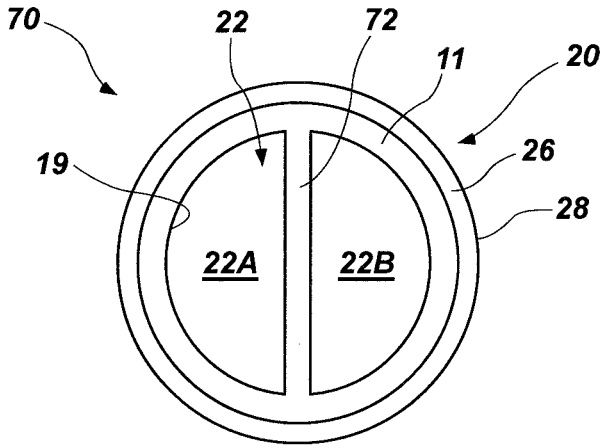
FIG. 6 is a top plan view of another embodiment of a cutting element for an earth-boring tool similar to those of FIGS. 1A-1C and 2A-2C, but wherein the cutting element includes two recesses extending at least partially through the cutting element.

FIG. 6 is a top plan view, similar to those of FIGS. 1C and 2C, illustrating another embodiment of a cutting element 70 of the present disclosure that is substantially similar to the cutting element 50 of FIGS. 2A-2C, but that includes a cross-member 72 within the aperture 22, such that the aperture 22 is divided by the cross-member 72 into a first aperture region 22A and a second aperture region 22B, which aperture regions may also be characterized as individual apertures. In some embodiments, the cross-member 72 may extend across a geometric center of the cutting element 70, such that the first aperture region 22A and the second aperture region 22B are at least substantially identical in size and shape. In other embodiments, the cross-member 72 may be offset from the geometric center of the cutting element 70 such that the first aperture region 22A and the second aperture region 22B differ in size and/or shape.

The cross-member 72 may comprise an integral portion of the substrate 12, and may also include a portion of the volume of polycrystalline hard material 20. In other words, in some embodiments, the polycrystalline hard material 20 may include a region formed on, or attached to, a portion of the substrate 12 defining the cross-member 72. In such embodiments, of course, there will be an individual opening through the polycrystalline hard material 20 into an aperture region 22A, 22B. In other embodiments, the cross-member 72 may not include any polycrystalline hard material 20. The portion of the substrate 12 defining the cross-member 72 may extend across an entire depth of the substrate 12 between the front end surface 14 and the back end surface 16 thereof. In other embodiments, the portion of the substrate 12 defining the cross-member 72 may not extend across the entire depth of the substrate 12, and may comprise a beam extending across the aperture 22 proximate the front end surface 14 of the substrate 12.

Figure 7:
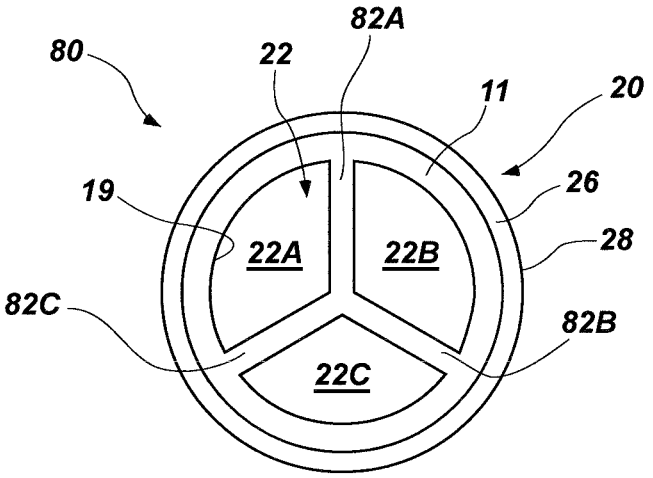
FIG. 7 is a top plan view of another embodiment of a cutting element for an earth-boring tool similar to those of FIGS. 1A-1C and 2A-2C, but wherein the cutting element includes three recesses extending at least partially through the cutting element.

Additional embodiments of cutting elements of the present disclosure may include any number and configuration of reinforcing cross-members similar to the cross-member 72 of FIG. 6. For example, FIG. 7 illustrates another embodiment of a cutting element 80 of the present disclosure that is substantially similar to the cutting element 50 of FIGS. 2A-2C and the cutting element 70 of FIG. 6, but that includes three intersecting cross-members 82A, 82B, 82C within the aperture 22, such that the aperture 22 is divided by the cross-members 82A-82C into a first aperture region 22A, a second aperture region 22B, and a third aperture region 22C, each of which may be characterized as an individual aperture. In some embodiments, the cross-members 82A-82C may intersect at or near a geometric center of the cutting element 80, such that the first aperture region 22A, the second aperture region 22B, and the third aperture 22C are at least substantially identical in size and shape. In other embodiments, the intersection of the cross-members 82A-82C may be displaced from the geometric center of the cutting element 80 such that the aperture regions 22A-22C differ in size and/or shape.

The cross-members 82A-82C may comprise integral portions of the substrate 12, and may also include a portion of the volume of polycrystalline hard material 20. In other words, in some embodiments, the polycrystalline hard material 20 may include a region formed on, or attached to, portions of the substrate 12 defining the intersecting cross-members 82A-82C. In such embodiments, of course, there will be an individual opening through the polycrystalline hard material 20 into an aperture region 22A, 22B, 22C. In other embodiments, the cross-members 82A-82C may not include any polycrystalline hard material 20 thereon. The portions of the substrate 12 defining the cross-members 82A-82C may extend across an entire depth of the substrate 12 between the front end surface 14 and the back end surface 16 thereof. In other embodiments, the portions of the substrate 12 defining the cross-members 82A-82C may not extend across the entire depth of the substrate 12, and may comprise beams extending across the aperture 22 proximate the front end surface 14 of the substrate.

In the embodiments of FIGS. 6 and 7, cross-members 72, 82A, 82B, 82C of substrate material or bearing a portion of polycrystalline material 20 may function as so-called "chip breakers" upon contact by formation cuttings 154 to fracture such formation cuttings 154 into smaller particles, facilitating removal from the face of a drill bit by drilling fluid flowing in front of cutting elements 70, 80.

Figure 8A:
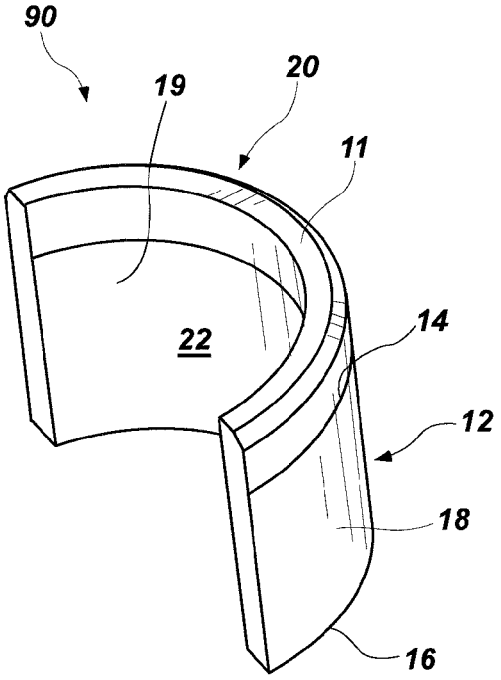
FIG. 8A is a perspective view of another embodiment of a cutting element similar to that of FIGS. 2A-2C, but wherein the cutting element comprises only a portion of a ring.
Figure 8B:
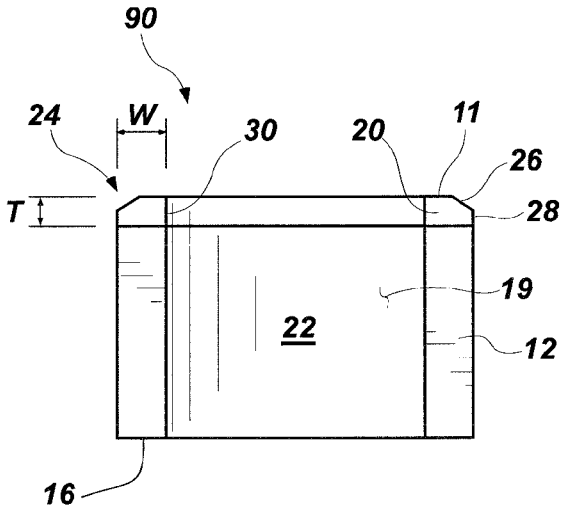
FIG. 8B is a side plan view of the cutting element of FIG. 8A.
Figure 8C:
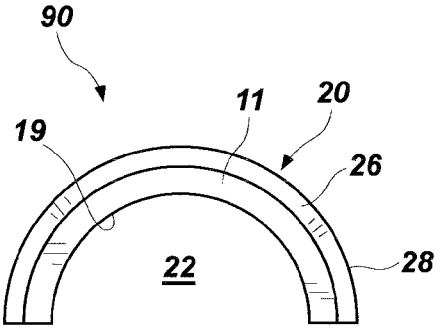
FIG. 8C is a top plan view of the cutting element of FIGS. 8A and 8B.

Although the cutting elements previously described herein have an annular configuration, additional embodiments of the cutting elements of the present disclosure may not have a complete annular or ring-shaped configuration, but may have an arcuate configuration. In other words, such cutting elements may have a curved shape, which may also be characterized as "arcuate" and which may or may not correspond to a portion of a circle or oval. FIGS. 8A-8C illustrate a non-limiting example of such a cutting element 90 of the present disclosure. The cutting element 90 has a configuration corresponding to a portion of the cutting element 50 of FIGS. 2A-2C, and includes a curved substrate 12 and a volume of polycrystalline hard material 20 disposed on an end surface of the curved substrate 12. The cutting element 90 may be formed as previously described herein. The curved substrate 12 comprises a partial cylinder and has a front end surface 14, a back end surface 16, and a curved outer lateral side surface 18. The substrate 12 also has a curved inner side surface 19. The volume of polycrystalline diamond 20 is disposed on the front end surface 14 as previously described herein, and has a cutting edge 24 (FIG. 8B) defined at the outer periphery of a front cutting face 11 of the volume of polycrystalline hard material 20. One or more chamfer surfaces 26 may be present at the cutting edge 24 and may extend between the front cutting face 11 and an outer lateral side surface 28 of the volume of polycrystalline hard material 20. Cutting edge 24 may also include a radiused or other arcuate cross-section, alone or in combination with one or more chamfer surfaces.

The cutting element 90 may be attached to a body of an earth-boring tool, such as the bit body 102 of the drill bit 100 of FIG. 3, such that the cutting edge 24 of the cutting element 90 will engage and cut formation material during use of the earth-boring tool as previously described herein.

The curved configuration of the cutting element 90 defines an aperture 22 within the cutting element. Additionally, the volume of polycrystalline hard material 20 may have a radial width W and thickness T as previously described herein. In this configuration, when the cutting element 90 is used to cut formation material, the formation cuttings may slide only a short distance across the front cutting face 11 of the cutting element 90 before reaching the aperture 22. Thus, the cutting element 90 also may be used to attain the benefits over previously known cutting elements previously discussed herein with reference to FIGS. 4A and 4B.

While the present disclosure has been described with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. A cutting element for an earth-boring tool, comprising:

a substrate having a front end surface, an opposing back end surface, and at least one side surface extending between the front end surface and the back end surface; and a volume of polycrystalline hard material disposed on the front end surface, the volume of polycrystalline hard material having an annular configuration defining at least one aperture extending through the volume of polycrystalline hard material, the volume of polycrystalline hard material having an average radial width in radial directions perpendicular to a longitudinal axis of the cutting element of 3.0 mm or less, the at least one aperture devoid of solid material and at least partially defining a volume of space within the cutting element having one or more openings through the volume of polycrystalline hard material to the volume of space from the exterior of the cutting element.

2. The cutting element of claim 1, wherein the substrate is a cylindrical body comprising a cemented tungsten carbide composite material.

3. The cutting element of claim 1, wherein the volume of polycrystalline hard material comprises a volume of polycrystalline diamond.

4. The cutting element of claim 1, wherein the at least one aperture extends partially but not entirely through the substrate.

5. The cutting element of claim 4, wherein the at least one aperture extends a depth into the cutting element of at least about two millimeters (2.0 mm).

6. The cutting element of claim 1, wherein the volume of polycrystalline hard material having the annular configuration has an average thickness in a direction perpendicular to a front cutting face of the volume of polycrystalline hard material of between about one and one-half millimeters (1.5 mm) and about five millimeters (5.0 mm).

7. The cutting element of claim 1, wherein the volume of polycrystalline hard material has a polished front cutting surface having an average Ra surface roughness of about 8.0 μ-in. or less.

8. The cutting element of claim 1, wherein the at least one aperture comprises two or more apertures divided by one or more cross-members.

9. An earth-boring tool, comprising:

a body; and a cutting element attached to the body, the cutting element comprising:

a substrate having a front end surface, an opposing back end surface, and at least one side surface extending between the front end surface and the back end surface; and a volume of polycrystalline hard material disposed on the front end surface, the volume of polycrystalline hard material having an annular configuration defining at least one aperture extending through the volume of polycrystalline hard material, the volume of polycrystalline hard material having an average radial width in radial directions perpendicular to a longitudinal axis of the cutting element of 3.0 mm or less, the at least one aperture devoid of solid material and at least partially defining a volume of space within the cutting element having one or more openings through the volume of polycrystalline hard material to the volume of space from the exterior of the cutting element and the body of the earth-boring tool.

10. The earth-boring tool of claim 9, wherein the body comprises a bit body of a fixed-cutter rotary drill bit.

11. The earth-boring tool of claim 9, wherein the at least one aperture extends entirely through the substrate.

12. The earth-boring tool of claim 9, wherein the volume of polycrystalline hard material having the annular configuration has an average thickness in a direction perpendicular to a front cutting face of the volume of polycrystalline hard material of between about one and one-half millimeters (1.5 mm) and about five millimeters (5.0 mm).

13. The earth-boring tool of claim 9, wherein the volume of polycrystalline hard material has a polished front cutting surface having an average Ra surface roughness of about 8.0 μ-in. or less.

14. A method of forming an earth-boring tool, comprising:

attaching a cutting element to a body of the earth-boring tool, the cutting element including a substrate having a front end surface, an opposing back end surface, and at least one side surface extending between the front end surface and the back end surface, the cutting element further including a volume of polycrystalline hard material disposed on the front end surface of the substrate, the volume of polycrystalline hard material having an annular configuration defining an aperture extending through the volume of polycrystalline hard material, the volume of polycrystalline hard material having an average radial width in radial directions perpendicular to a longitudinal axis of the cutting element of 3.0 mm or less; and configuring and orienting the cutting element and the body of the earth-boring tool such that the aperture defines a void comprising a volume of space within the cutting element having one or more openings through the volume of polycrystalline hard material to the volume of space from the exterior of the cutting element and the body of the earth-boring tool.

15. The method of claim 14, further comprising selecting the body to comprise a bit body of a fixed-cutter rotary drill bit.

16. The method of claim 14, further comprising configuring and orienting the cutting element and the body of the earth-boring tool such that the aperture extends entirely through the substrate.

17. The method of claim 14, further comprising selecting the cutting element to comprise an annular layer of the polycrystalline hard material having an average thickness in a direction perpendicular to a front cutting face of the volume of polycrystalline hard material of between about one and one-half millimeters (1.5 mm) and about five millimeters (5.0 mm).

18. The method of claim 14, further comprising selecting the cutting element to have a polished front cutting surface having an average Ra surface roughness of about or 8.0 μ-in. or less.

19. A cutting element for an earth-boring tool, comprising:

a curved substrate having a front end surface, an opposing back end surface, a curved outer lateral side surface extending between the front end surface and the back end surface, and a curved inner lateral side surface extending between the front end surface and the back end surface; and a volume of polycrystalline hard material disposed on the front end surface of the substrate, the volume of polycrystalline hard material having a radial width of 3.0 mm or less in a direction extending between the curved outer lateral side surface and the curved inner lateral side surface of the substrate, the volume of polycrystalline hard material having a polished front cutting surface having an average Ra surface roughness of about 8.0 μ-in. or less.

* * * * *